US010229621B2

(12) United States Patent
Shin

(10) Patent No.: US 10,229,621 B2
(45) Date of Patent: Mar. 12, 2019

(54) DISPLAY DEVICE AND CALIBRATION METHOD THEREOF

(71) Applicant: SAMSUNG DISPLAY CO., LTD., Yongin, Gyeonggi-Do (KR)

(72) Inventor: Jeong-Hwan Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 531 days.

(21) Appl. No.: 14/645,310

(22) Filed: Mar. 11, 2015

(65) Prior Publication Data

US 2016/0063950 A1 Mar. 3, 2016

(30) Foreign Application Priority Data

Sep. 3, 2014 (KR) ..... 10-2014-0117101

(51) Int. Cl.
*G09G 3/20* (2006.01)
*G09G 3/3233* (2016.01)

(52) U.S. Cl.
CPC ..... *G09G 3/20* (2013.01); *G09G 3/3233* (2013.01); *G09G 2300/08* (2013.01); *G09G 2310/0291* (2013.01); *G09G 2320/0204* (2013.01); *G09G 2320/029* (2013.01); *G09G 2320/045* (2013.01); *G09G 2320/0693* (2013.01)

(58) Field of Classification Search
CPC ..... G09G 5/0006; G09G 2320/0204; G09G 2310/0291; G09G 2320/0693; G09G 3/20; G09G 3/3233; G09G 2300/08; G09G 2320/029; G09G 2320/045
See application file for complete search history.

(56) References Cited

U.S. PATENT DOCUMENTS

| | | | | |
|---|---|---|---|---|
| 7,245,277 | B2 | 7/2007 | Ishizuka | |
| 8,115,707 | B2 | 2/2012 | Nathan et al. | |
| 2008/0284758 | A1* | 11/2008 | Lee | G09G 3/3688 345/204 |
| 2009/0160740 | A1* | 6/2009 | Leon | G09G 3/3291 345/76 |
| 2010/0277400 | A1* | 11/2010 | Jeong | G09G 3/3275 345/76 |
| 2013/0093653 | A1* | 4/2013 | Ota | G09G 3/3233 345/77 |
| 2015/0035813 | A1* | 2/2015 | Lei | G09G 3/3208 345/205 |

FOREIGN PATENT DOCUMENTS

| | | | |
|---|---|---|---|
| KR | 10-2007-0035530 | A | 3/2007 |
| KR | 10-2007-0078522 | A | 8/2007 |
| KR | 10-2012-0025655 | A | 3/2012 |

* cited by examiner

*Primary Examiner* — Sahlu Okebato
(74) *Attorney, Agent, or Firm* — Lewis Roca Rothgerber Christie LLP

(57) ABSTRACT

A display device includes: a plurality of pixels; a plurality of data lines coupled to the pixels and grouped into a plurality of groups; a plurality of channels corresponding to the plurality of groups, each of the channels being configured to sense a current flowing to a data line of a corresponding group from among the data lines to output a code value; and a controller configured to calibrate a deviation of a gain and an offset of the channels based on the code value of each of the channels.

18 Claims, 12 Drawing Sheets

DISPLAY DEVICE AND CALIBRATION METHOD THEREOF

CROSS-REFERENCE TO RELATED APPLICATION

This application claims priority to and the benefit of Korean Patent Application No. 10-2014-0117101 filed in the Korean Intellectual Property Office on Sep. 3, 2014, the entire contents of which are incorporated herein by reference.

BACKGROUND

1. Field

One or more aspects of example embodiments of the present invention relate to a display device and a calibration method thereof.

2. Description of the Related Art

Active display devices such as an organic light emitting diode (OLED) display and a liquid crystal display (LCD) include a plurality of pixels connected to a plurality of scan lines extending in a row direction and a plurality of data lines extending in a column direction. A scan driving device sequentially applies a scan pulse to the plurality of scan lines, and a data driving device applies data to the plurality of data lines to write desired data to the pixels and display an image.

In this instance, degradation of a light-emitting device, for example, an organic light emitting diode (OLED), may generate a deviation (or variation) of a current flowing to the plurality of data lines. The display device accordingly senses the current flowing to the data lines to determine a degradation degree of the light-emitting device, and performs calibration depending on the degradation degree.

In general, several data lines are combined into a single channel and are sensed to measure the current, and many channels are used to measure the current flowing to all the data lines. In this instance, the channels may have deviations (or variations) so that they may be measured to have different values by the deviation (or variation) of channels irrespective of the same current value. The calibration values become different by the channel deviation (or variation), so when the light-emitting device is calibrated by its degradation, the current flowing to the data line may generate a deviation (or variation).

The above information disclosed in this Background section is only for enhancement of understanding of the background of the invention and therefore it may contain information that does not form the prior art that is already known to a person of ordinary skill in the art.

SUMMARY

One or more aspects of example embodiments of the present invention provide a display device for calibrating a deviation (or variation) of a channel, and a calibration method thereof.

According to an embodiment of the present invention a display device includes: a plurality of pixels; a plurality of data lines coupled to the pixels and grouped into a plurality of groups; a plurality of channels corresponding to the plurality of groups, each of the channels being configured to sense a current flowing to a data line of a corresponding group from among the data lines to output a code value; and a controller configured to calibrate a deviation of a gain and an offset of the channels based on the code value of each of the channels.

Each of the channels may include: an amplifier including a first input terminal, a second input terminal configured to receive an input voltage, and an output terminal coupled to the data line of the corresponding group; and an analog to digital converter (ADC) including an input terminal coupled to the first input terminal, and an output terminal configured to output the code value.

The controller may be configured to calibrate the deviation of the offset by setting the input voltage to be lower than a threshold voltage.

The threshold voltage may control a current flowing through the data line to have a value that is less than a predetermined current.

The controller may be configured to calibrate the deviation of the offset based on the code value output by the ADC when the input voltage is set to be lower than a threshold voltage.

The controller may be configured to calibrate the deviation of the offset on each of the channels based on an average value of the code values of at least two of the data lines corresponding to each of the channels.

The controller may be configured to calibrate the deviation of the gain by setting the input voltage as a first voltage and a second voltage in turn, and the first voltage and the second voltage may be higher than a predetermined voltage.

The predetermined voltage may control the current flowing to the data line to be operable in a linear region.

The controller may be configured to calibrate the deviation of the gain based on a first code value output by the ADC when the input voltage may be set to be the first voltage, and a second code value output by the ADC when the input voltage may be set to be the second voltage.

The controller may be configured to calibrate the deviation of the gain based on a slope that corresponds to a difference between the first code value and the second code value.

The controller may be configured to calculate the slope for each of the channels, determine a trend line of slopes for the plurality of channels, and calibrate the deviation of the gain for each of the channels based on a ratio of the slope on the trend line and the slope calculated for a corresponding channel.

The controller may be configured to determine an average value of the slopes on at least two of the data lines corresponding to each of the channels to be the slope for the corresponding channel.

According to another embodiment of the present invention a method of performing a calibration by a display device including a plurality of pixels, a plurality of data lines coupled to the pixels and grouped into a plurality of groups, and a plurality of channels corresponding to the plurality of groups includes: sensing a current flowing to a data line of each group from among the data lines by a channel corresponding to the group; converting the current sensed by the channel into a code value to output the code value; and calibrating a deviation of a gain and an offset of the channel based on the code value.

The outputting of the code value may include: applying an input voltage to a first input terminal of an amplifier, the amplifier including the first input terminal, a second input terminal, and an output terminal coupled to the data line of the corresponding group; and outputting the code value by an analog to digital converter (ADC) comprising an input terminal coupled to the second input.

The calibrating of the deviation may include: setting the input voltage to be lower than a threshold voltage; and calibrating the deviation of the offset based on the code value output by the ADC when the input voltage may be set to be lower than the threshold voltage.

The calibrating of the deviation of the offset may further include setting an average value of the code values of at least two of the data lines corresponding to the channel to be the code value for calibrating the deviation of the offset.

The calibrating of the deviation may include: setting the input voltage to be a first voltage that is higher than a predetermined voltage; setting the input voltage to be a second voltage that is higher than the predetermined voltage; and calibrating the deviation of the gain based on a first code value output by the ADC when the input voltage may be set to be the first voltage, and a second code value output by the ADC when the input voltage may be set to be the second voltage.

The calibrating of the deviation of the gain may further include calibrating the deviation of the gain based on a slope that corresponds to a difference between the first code value and the second code value.

The calibrating of the deviation of the gain may further include: calculating the slope for each of the channels; determining a trend line of slopes for the plurality of channels; and calibrating the deviation of the gain based on a ratio of the slope on the trend line to the slope calculated for each of the channels.

The calibrating of the deviation of the gain may further include setting an average value of the slopes on at least two of the data lines corresponding to the channel to be the slope for the channel.

BRIEF DESCRIPTION OF THE DRAWINGS

The above and other aspects and features of the present invention will become apparent to those skilled in the art from the following detailed description of the example embodiments with reference to the accompanying drawings.

DETAILED DESCRIPTION

Figure 1:
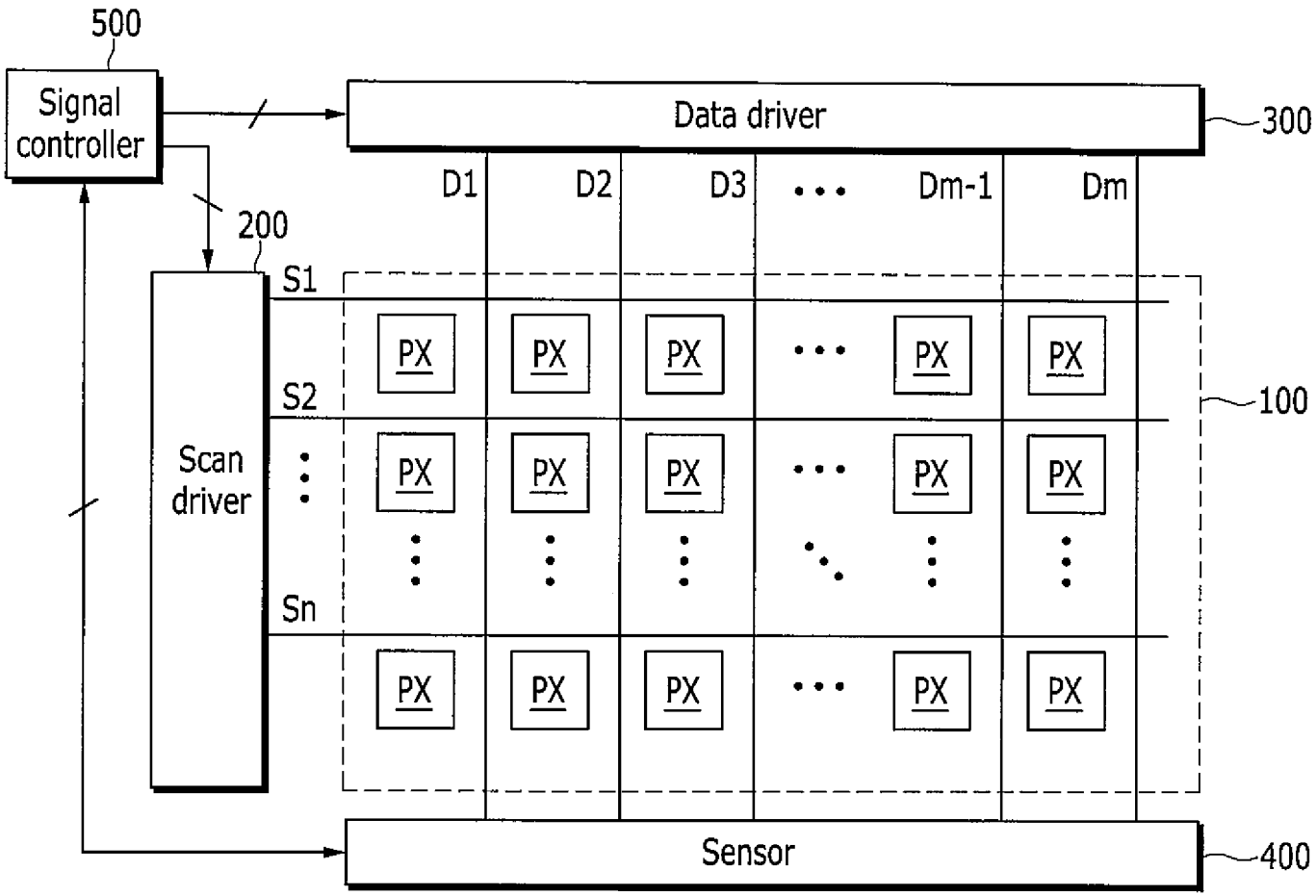
FIG. 1 shows a block diagram of a display device according to an embodiment of the present invention.

In the following detailed description, certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 shows a block diagram of a display device according to an embodiment of the present invention.

Referring to FIG. 1, the display device includes a display unit 100, a scan driver 200, a data driver 300, a sensor 400, and a signal controller 500 for controlling them.

In an equivalent circuit manner, the display unit 100 includes a plurality of display signal lines S1-Sn and D1-Dm, and a plurality of pixels PX connected thereto and arranged substantially in a matrix form. The display unit 100 may include lower and upper panels facing each other.

The display signal lines S1-Sn and D1-Dm include a plurality of scan lines (S1-Sn) for transmitting scan signals (also called gate signals) and a plurality of data lines D1-Dm for transmitting data signals. The scan lines S1-Sn are extended substantially in a row direction and are substantially parallel to each other, and the data lines D1-Dm are extended substantially in a column direction and are substantially parallel to each other.

The pixels PX may include a transistor (e.g., a switching transistor) including a gate connected to the scan line and a source or a drain connected to a data line. The transistor transmits a data signal provided by the data line in response to a gate-on voltage provided by the scan line. The pixel further includes a light emitting region for expressing grays (e.g., grayscale values or levels) according to the data signal provided by the transistor. When the display device is an organic light emitting device, the light emitting region may include a capacitor for storing the data signal, a driving transistor for transmitting a current according to the data signal stored in the capacitor, and an organic light emitting diode for expressing the grays (e.g., grayscale values or levels) according to the current provided by the driving transistor.

The scan driver 200 applies the scan signals that are a combination of a gate-on voltage and a gate-off voltage to the scan lines $S_1$-$S_n$ according to a control signal provided by the signal controller 500. The gate-on voltage is applied to the gate of the transistor to turn on the transistor, and the gate-off voltage is applied to the gate of the transistor to turn off the transistor.

The data driver 300 generates data signals for expressing the grays (e.g., grayscale values or levels) of the pixels PX according to input data provided by the signal controller 500, and applies the data signals to the data lines D1-Dm.

The sensor 400 senses current flowing to the data lines D1-Dm.

The signal controller 500 controls the scan driver 200 and the data driver 300. The signal controller 500 determines a calibration value for calibrating a deviation (or variation) induced by degradation of the organic light emitting diode based on the current sensed by the sensor 400, and calibrates the input data based on the calibration value. In some embodiments, the signal controller 500 also calibrates an error generated by a channel deviation (or variation) of the sensor 400.

The drivers 200, 300, 400, and 500 may be directly mounted as at least one IC chip on the display unit 100, mounted on a flexible printed circuit film and attached as a tape carrier package (TCP) to the display unit 100, or mounted to an additional printed circuit board (PCB) that is connected to the display unit 100. However, the manner in which the drivers 200, 300, 400, and 500 are mounted and/or connected to the display unit 100 is not limited thereto. For example, the drivers 200, 300, 400, and 500 may be integrated in the display unit 100 together with the signal lines $S_1$-$S_n$ and $D_1$-$D_m$ and the transistor. Further, for example, the drivers 200, 300, 400, and 500 may be integrated into a single chip, and at least one of them or at least one circuit element configuring them may be provided outside the single chip.

Figure 2:
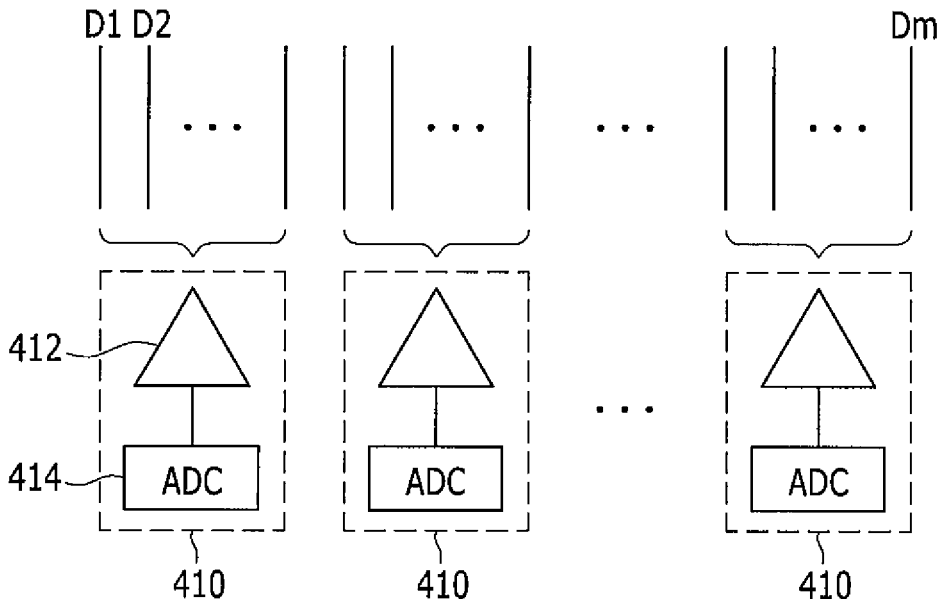
FIG. 2 shows a block diagram of a sensor of a display device according to an embodiment of the present invention.

FIG. 2 shows a block diagram of a sensor of a display device according to an embodiment of the present invention.

Referring to FIG. 2, the sensor 400 shown in FIG. 1 includes a plurality of channels 410, each of which includes an amplifier 412 and an analog to digital converter (ADC) 414. Each of the channels 410 is connected to a plurality of data lines from among the data lines D1 through Dm. The channel 410 may be connected to the amplifier 412 by sequentially selecting one of the data lines by use of a multiplexer.

Figure 3:
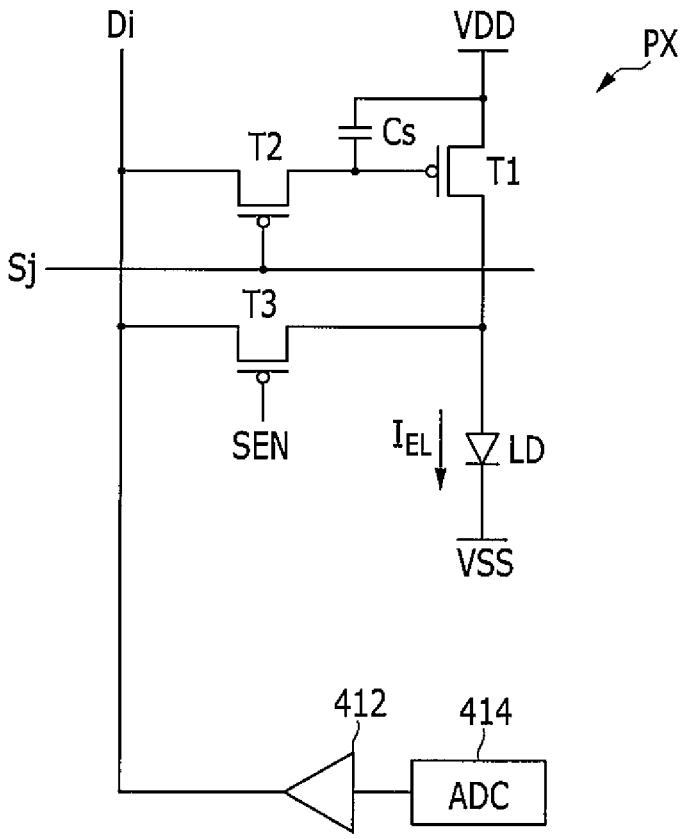
FIG. 3 shows an example of a pixel of a display device according to an embodiment of the present invention.

FIG. 3 shows an example of a pixel of a display device according to an embodiment of the present invention.

FIG. 3 shows an example in which the amplifier 412 is connected to a single data line Di, and a pixel PX is connected to the data line Di.

Referring to FIG. 3, the pixel PX may include a driving transistor T1, a switching transistor T2, a sensing transistor T3, a capacitor Cs, and an organic light emitting diode LD.

The driving transistor T1 includes an input terminal connected to a power source VDD (e.g., a first power source), and an output terminal connected to a first terminal of the organic light emitting diode LD (e.g., an anode terminal). The organic light emitting diode LD includes a, second terminal (e.g., a cathode terminal) connected to a power source VSS (e.g., a second power source).

The switching transistor T2 includes a control terminal connected to the scan line Sj, an input terminal connected to the data line Di, and an output terminal connected to a control terminal of the driving transistor T1.

The sensing transistor T3 includes an input terminal connected to the data line Di, an output terminal connected to the output terminal of the driving transistor T1, and a control terminal connected to a sensing line SEN.

The capacitor Cs includes a first terminal connected to the output terminal of the switching transistor T2 and the control terminal of the driving transistor T1, and a second terminal connected to the power source VDD.

Therefore, when the switching transistor T2 is turned on in response to the scan signal from the scan line Sj, the data signal from the data line Di, that is, the data voltage, is charged in the capacitor Cs. The driving transistor T1 outputs a current that corresponds to the voltage charged in the capacitor Cs, and the organic light emitting diode LD emits light according to the current.

During an operation for sensing degradation of the organic light emitting diode LD, the sensing transistor T3 is turned on in response to a control signal applied to the sensing line SEN. A current $I_{EL}$ flows to the organic light emitting diode LD from the data line $D_i$ according to an output voltage of the amplifier 412. In this instance, the sensor 400 senses the current $I_{EL}$ flowing through the data line $D_i$.

Figure 4:
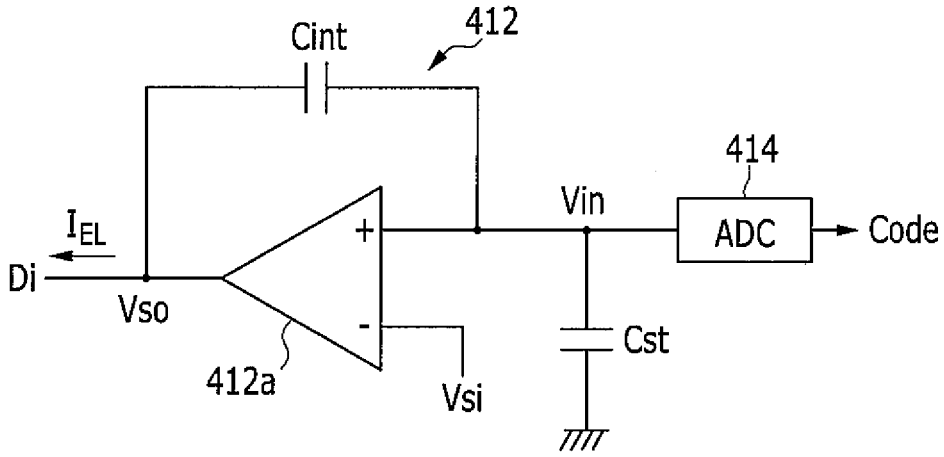
FIG. 4 shows an example of an amplifier of a channel according to an embodiment of the present invention.
Figure 5:
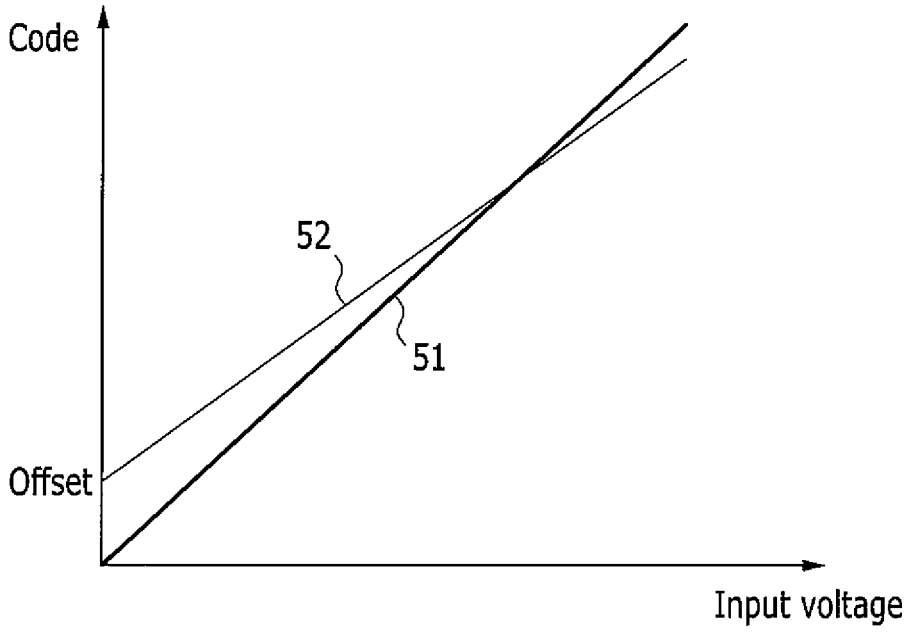
FIG. 5 shows a gain of an ADC in a channel according to an embodiment of the present invention.

FIG. 4 shows an example of an amplifier of a channel according to an embodiment of the present invention, and FIG. 5 shows a gain of an ADC in a channel according to an embodiment of the present invention.

Referring to FIG. 4, the amplifier 412 may include an operational amplifier (OP-AMP) 412*a*, and capacitors Cst and Cint.

The operational amplifier 412*a* includes a negative input terminal for receiving a voltage Vsi (e.g., a predetermined voltage), and a positive input terminal connected to an input terminal of the ADC 414. The operational amplifier 412*a* includes an output terminal connected to the data line Di.

The capacitor Cst is connected between the positive input terminal of the operational amplifier 412*a* and a ground. The capacitor Cint is connected between the positive input terminal of the operational amplifier 412*a* and the output terminal of the operational amplifier 412*a*.

Therefore, a current $I_{EL}$ flows to the organic light emitting diode LD through the data line Di according to an output voltage Vso that is output at the output terminal of the operational amplifier 412*a* according to a voltage Vsi (e.g., a predetermined voltage). The capacitor Cst is charged by the current $I_{EL}$ flowing to the organic light emitting diode LD from the output terminal of the amplifier 412, to determine a voltage at the positive input terminal of the amplifier 412, that is, the input voltage of the ADC 414. Therefore, the input voltage of the ADC 414 is determined by the current $I_{EL}$ of the organic light emitting diode LD, capacitance of the capacitor Cst, and a charging time of the capacitor Cst. That is, the input voltage Vin of the ADC 414 is determined by a product of the current $I_{EL}$ of the organic light emitting diode LD and a gain Gain_amp of the amplifier 412 as expressed in Equation 1.

$$Vin = Gain_amp \times I_{EL} \quad \text{Equation 1}$$

In Equation 1 above, the gain Gain_amp of the amplifier 412*a* is a value that is determined by the capacitance of the capacitor Cst and the charging time of the capacitor Cst.

The ADC 414 converts the input voltage Vin into a digital value, and outputs the digital value as a digital code. In general, regarding the ADC 414, the code corresponds to the input voltage Vin of the ADC 414 one by one as shown by the line 51 in FIG. 5. For example, in the case of an 8-bit ADC 414, the ADC 414 has codes of 0 to 255, the code 0 corresponds to 0V, the code 255 corresponds to a reference voltage Vref, and the code n corresponds to n*(Vref/255). In this case, (input voltage)*(255/Vref) may be a gain Gain_adc of the ADC 414. As shown by the line 52 in FIG. 5, the gain of the ADC 414 may be deviated by an offset due to an error of the ADC 414. The code output by the ADC 414 is expressed in Equation 2.

$$Code = Gain_adc \times Vin + Offset \quad \text{Equation 2}$$

In Equation 2 above, the Gain_adc is a gain of the ADC 414, and Offset is an offset value of the ADC 414.

The code of the ADC 414 may be expressed in Equation 3 according to Equation 1 and Equation 2.

$$Code = Gain \times I_{EL} + Offset \quad \text{Equation 3}$$

In Equation 3 above, the Gain is a gain induced by the ADC 414 and the amplifier 412, and may represent a product of Gain_adc and Gain_amp (i.e., Gain_adc×Gain_amp).

There may be a gain deviation (or variation) between the channels and there may be an offset deviation (or variation) between the channels according to characteristics of the amplifiers 412 and the ADCs 414.

A method for calibrating a deviation (or variation) of a gain and an offset will now be described with reference to FIG. 6 to FIG. 9.

Figure 6:
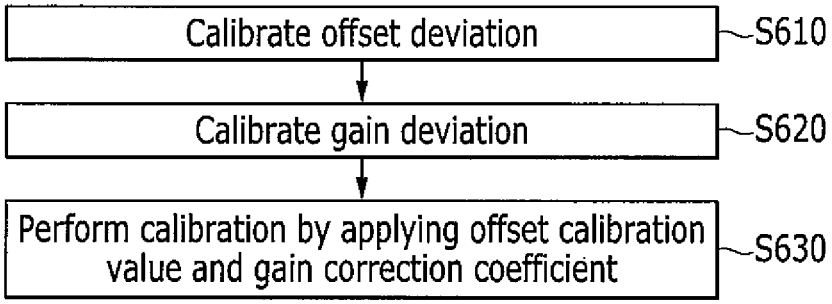
FIG. 6 shows a flowchart of a calibration method according to an embodiment of the present invention.
Figure 7:
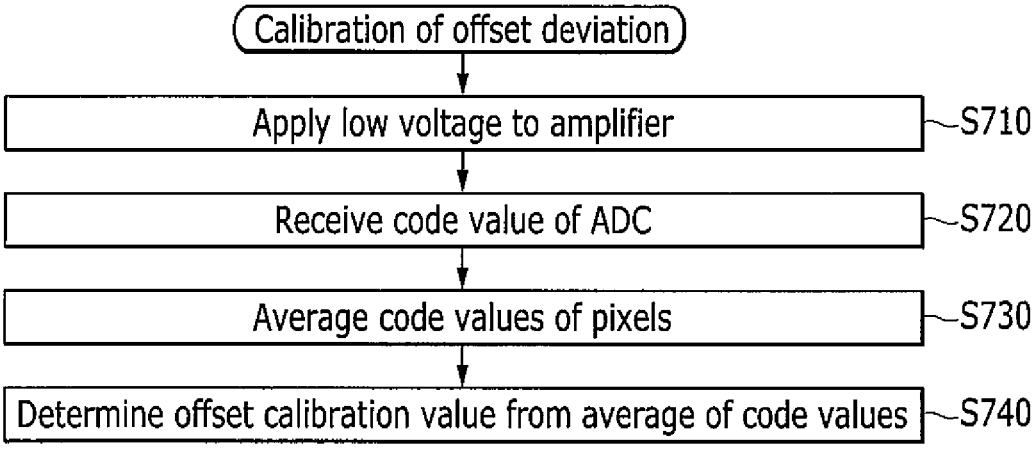
FIG. 7 shows a flowchart of a process for calibrating an offset deviation (or variation) in the calibration method shown in FIG. 6.
Figure 8:
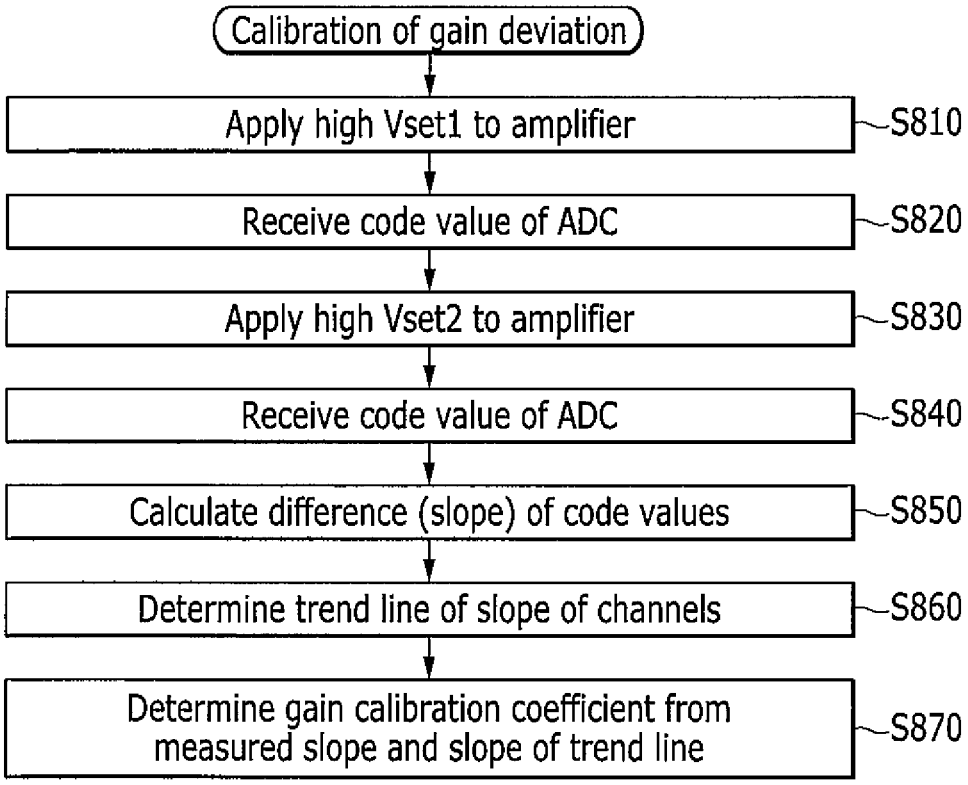
FIG. 8 shows a flowchart of a process for calibrating a gain deviation (or variation) in the calibration method shown in FIG. 6.
Figure 9:
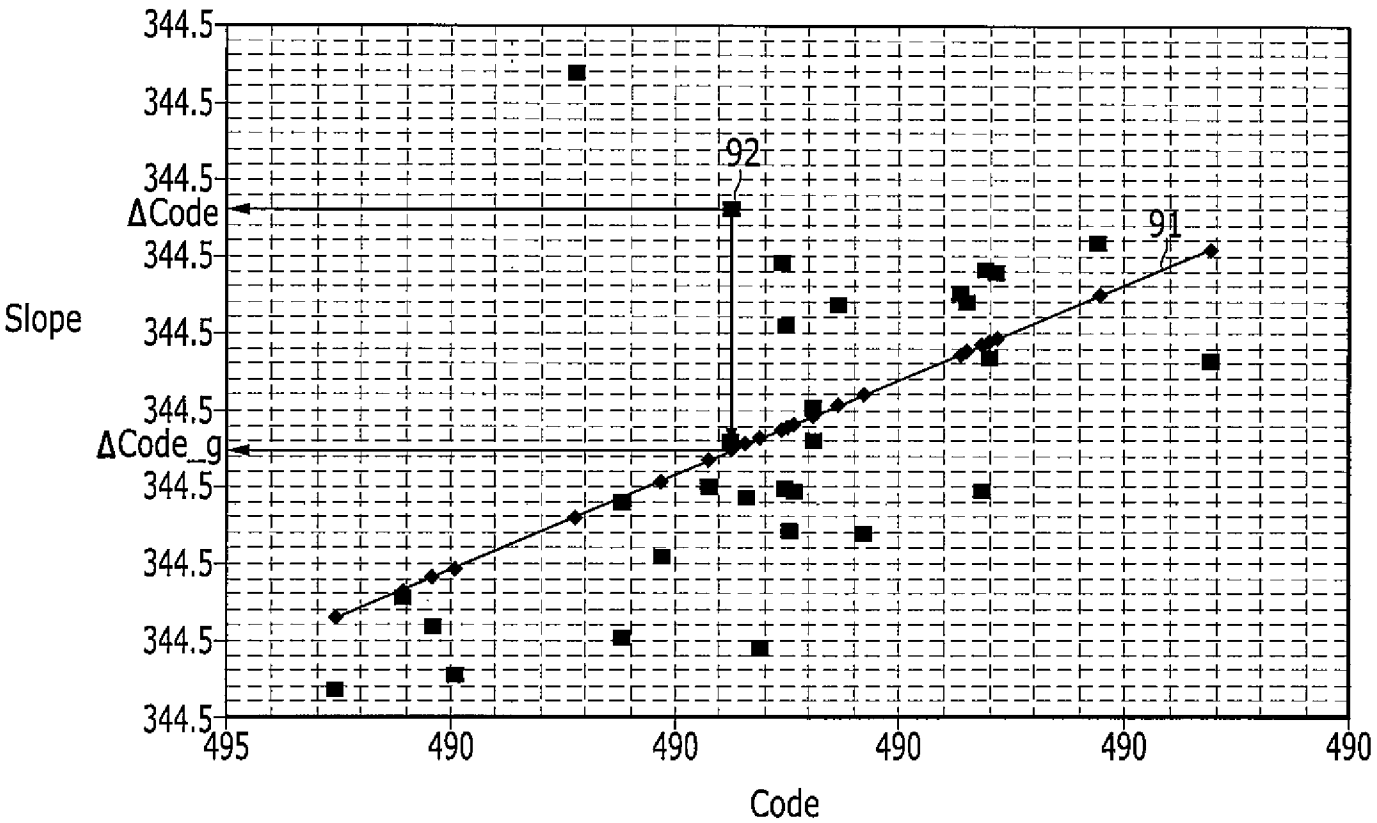
FIG. 9 shows a trend line in the process for calibrating a gain deviation (or variation) shown in FIG. 8.

FIG. 6 shows a flowchart of a calibration method according to an embodiment of the present invention, FIG. 7 shows a flowchart of a process for calibrating an offset deviation (or variation) in the calibration method shown in FIG. 6, FIG. 8 shows a flowchart of a process for calibrating a gain deviation (or variation) in the calibration method shown in FIG. 6, and FIG. 9 shows a trend line in the process for calibrating a gain deviation (or variation) shown in FIG. 8.

Referring to FIG. 6, the signal controller 500 performs a process for calibrating an offset deviation (or variation) to determine offset calibration values for respective channels (S610). The signal controller 500 performs a process for calibrating a gain deviation (or variation) to determine gain calibration coefficients for the respective channels (S620). In this instance, the signal controller 500 may perform either one of the processes for calibrating an offset deviation (or variation) (s610) or for calibrating a gain deviation (or variation) (s620) in advance of the other, or may concurrently (e.g., simultaneously) perform these processes together.

The signal controller 500 performs calibration by applying the offset calibration value and the gain calibration coefficient (S630) to the input data. That is, the signal controller 500 calibrates the input data based on the offset calibration value and the gain calibration coefficient. For example, the signal controller 500 may calibrate the input data by adding an offset calibration value of a corresponding channel to the input data for the pixel PX and multiplying the added value by a gain calibration coefficient of the corresponding channel.

Referring to FIG. 7, regarding the process for calibrating an offset deviation (or variation), the signal controller 500 controls the amplifier 412, so that a voltage Vset (e.g., a predetermined voltage) may be applied to the positive input terminal of the amplifier 412 (S710). In some embodiments, the voltage Vset is a voltage that allows the current $I_{EL}$ flowing to the organic light emitting diode LD to have a negligibly small value according to the output terminal voltage Vso of the amplifier 412 as determined by the voltage Vset. For example, the voltage Vset may be set to a voltage that is lower than a threshold voltage, and the threshold voltage may allow the current $I_{EL}$ to have a value that is less than a predetermined current.

When the current $I_{EL}$ has a negligibly small value in Equation 3, the product of the gain (Gain) and the current $I_{EL}$ converges to 0, so the output (Code) of the ADC 414 corresponds to the offset as expressed in Equation 4.

$$Code \approx Offset \quad \text{Equation 4}$$

The signal controller 500 receives the outputs of the ADCs 414 that are the code values from the respective channels 410 (S720), determines spreading of the offset values on the channels 410 based on the code values, and determines the offset calibration value for each of the channels (S740). Therefore, the signal controller 500 may calibrate the deviation (or variation) of the offset values on the channels based on the offset calibration value.

In some embodiments, the signal controller 500 receives the output (code value) of the ADC 414 measured from a plurality of pixels PX for respective channels 410, and determines the offset calibration value of the corresponding channel based on an average of the code values of the plurality of pixels PX (S730). An influence by a deviation (or variation) of the organic light emitting diode LD existing on the respective channels may be minimized or reduced by calculating the average of the code values of the pixels PX.

Referring to FIG. 8, in the process for calibrating a gain deviation (or variation), the signal controller 500 controls the amplifier 412, so that a first voltage Vset1 may be applied to a positive input terminal of the amplifier 412 (8810), and receives a code value from the ADC 412 (S820). In this instance, the first voltage Vset1 is higher than the voltage Vset (e.g., predetermined voltage) described above with reference to FIG. 7, and as shown in FIG. 9, the first voltage Vset1 allows the organic light emitting diode LD to be operable in a linear region according to the output voltage Vso of the amplifier 412.

The current $I_{EL}$ flowing to the organic light emitting diode LD is expressed in Equation 5, and the current $I_{EL}$ may be modeled in the linear region as expressed in Equation 6. The code value of the ADC. 414 is proportional to the current $I_{EL}$ of the organic light emitting diode LD, so for ease of illustration, the code value other than the current $I_{EL}$ is shown in FIG. 9.

$$I_{EL}=Is\times e^{Vd/Vt} \quad \text{Equation 5}$$

In Equation 5 above, Is is a saturation current of the organic light emitting diode, Vd is a voltage between two ends (e.g., first and second terminals) of the organic light emitting diode, and Vt is a thermal voltage.

$$I_{EL}=\alpha\times Vso+\text{Offset}_{EL} \quad \text{Equation 6}$$

Therefore, according to Equation 3 and Equation 6, the code value of the ADC 414 may be expressed as shown in Equation 7.

$$\text{Code}=\text{Gain}\times\alpha\times Vso+\text{Offset}^{*} \quad \text{Equation 7}$$

Hence, when the first voltage Vset1 is applied to the positive input terminal of the amplifier 412, and the output voltage of the amplifier 414 is Vso1, the code value Code1 is expressed as in Equation 8.

$$\text{Code1}=\text{Gain}\times\alpha\times Vso1+\text{Offset}^{*} \quad \text{Equation 8}$$

The signal controller 500 controls the amplifier 412, so that a second voltage Vset2 that is different from the first voltage Vset1 may be applied to the positive input terminal of the amplifier 412 (S830), and receives a code value from the ADC 412 (S840). When the second voltage Vset2 is applied to the positive input terminal of the amplifier 412, and the output voltage of the amplifier 414 is Vso2, the code value Code2 is given as expressed in Equation 9.

$$\text{Code2}=\text{Gain}\times\alpha\times Vso2+\text{Offset}^{*} \quad \text{Equation 9}$$

The signal controller 500 calculates a difference ΔCode between the code values measured for the first voltage Vset1 and the second voltage Vset2, that is, the slope in the linear region, as expressed in Equation 10 (S850).

$$\Delta\text{Code}=\text{Gain}\times\alpha\times(Vso2-Vso1) \quad \text{Equation 10}$$

In some embodiments, the signal controller 500 calculates an average of the differences ΔCode for a plurality of pixels PX within the channel, that is, the average of the slopes, as the slope of the corresponding channel. The influence caused by the deviation (or variation) of the organic light emitting diodes LD existing on the respective channels may be minimized or reduced by calculating the average of the code values on the pixels PX.

The signal controller 500 finds a distribution diagram of slopes for the plurality of channels as shown in FIG. 9, and determines a trend line 91 of the slopes from the distribution diagram (S860). In FIG. 9, a horizontal axis indicates an average of the code values at a random voltage on each of the channels. The random voltage may be one of the first voltage Vset1 and the second voltage Vset2, or may be another voltage.

The difference (i.e., slope) between the code values determined for each channel by the trend line is expressed in Equation 11. In this instance, a ratio of the slope ΔCode_g on the trend line 91 to the slope (i.e., ΔCode in Equation 10) measured for each channel 92 is given as a ratio of a gain on the trend line 91 for the gain of each channel as expressed in Equation 12. Therefore, the signal controller 500 determines the rate of the slope on the trend line for the code values of each channel to the slope (i.e., ΔCode in Equation 10) measured for each channel as a gain calibration coefficient COMP for the corresponding channel (S870).

$$\Delta\text{Code_}g=\text{Gain_}g\times\alpha\times(Vso2-Vso1) \quad \text{Equation 11}$$

$$\Delta\text{Code_}g/\Delta\text{Code}=\text{Gain_}g/\text{Gain}=\text{COMP} \quad \text{Equation 12}$$

Therefore, the signal controller 500 may calibrate the gain deviation (or variation) for the channel having a gain corresponding to the trend line from among a plurality of channels, based on the trend line.

As described above, according to some embodiments of the present invention, the deviation (or variation) of the gain and the offset among a plurality of channels may be calibrated, thereby preventing or reducing the deviation (or variation) of the current flowing to the organic light emitting diode, which may occur by the deviation (or variation) of the gain and the offset. Further, the deviation (or variation) of the gain and the offset may be calibrated without an additional device.

Figure 10:
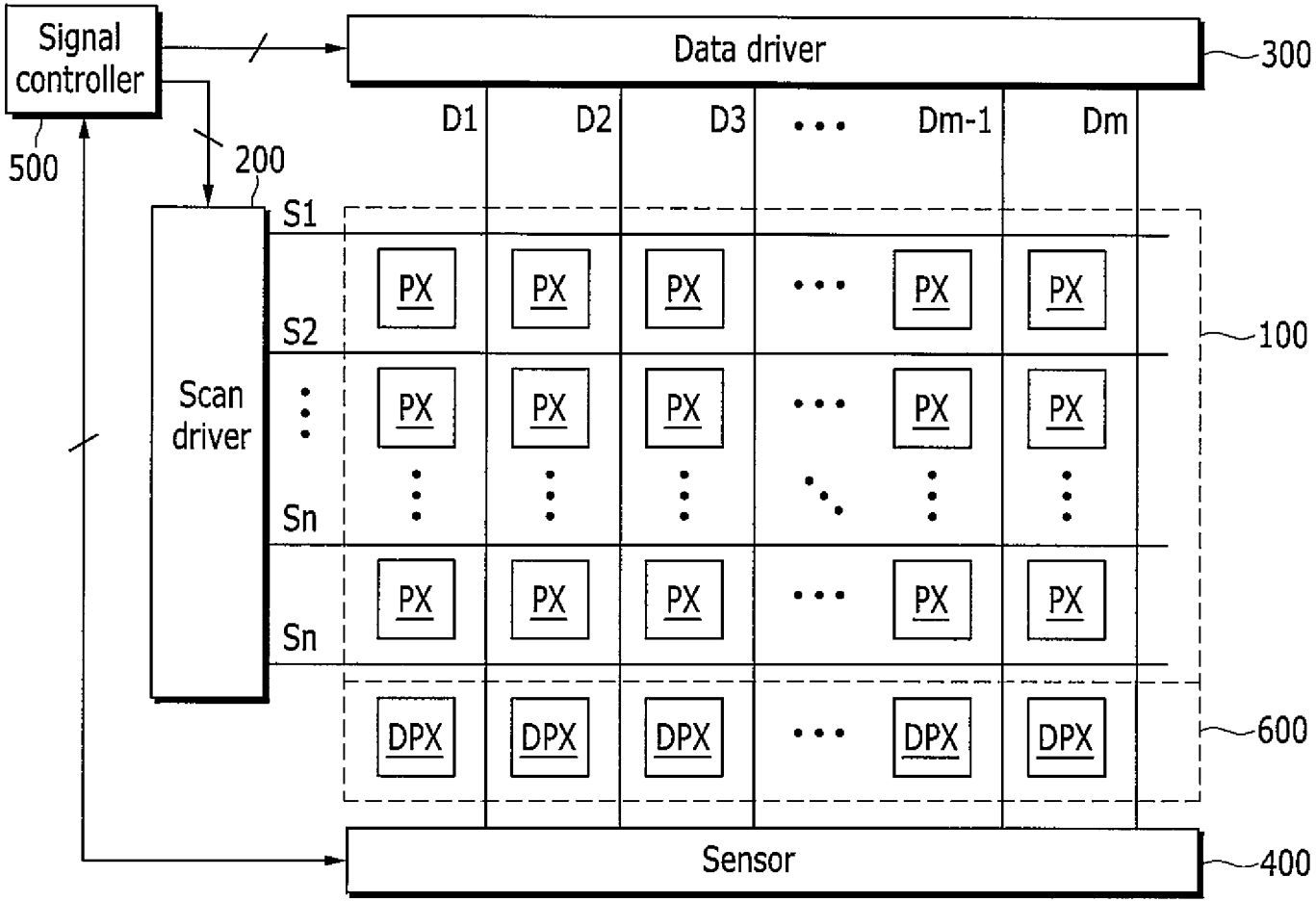
FIG. 10 shows a block diagram of a display device according to another embodiment of the present invention.
Figure 11:
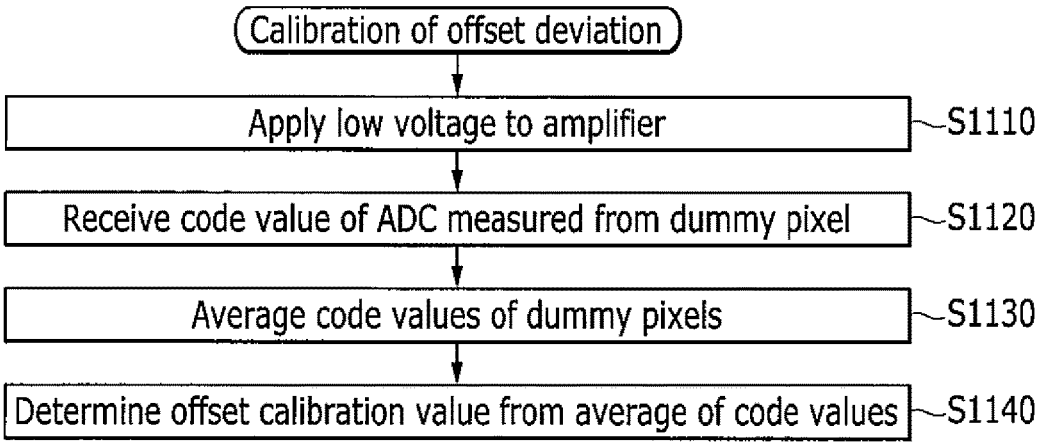
FIG. 11 shows a flowchart of a process for calibrating an offset deviation (or variation) in a calibration method according to another embodiment of the present invention.
Figure 12:
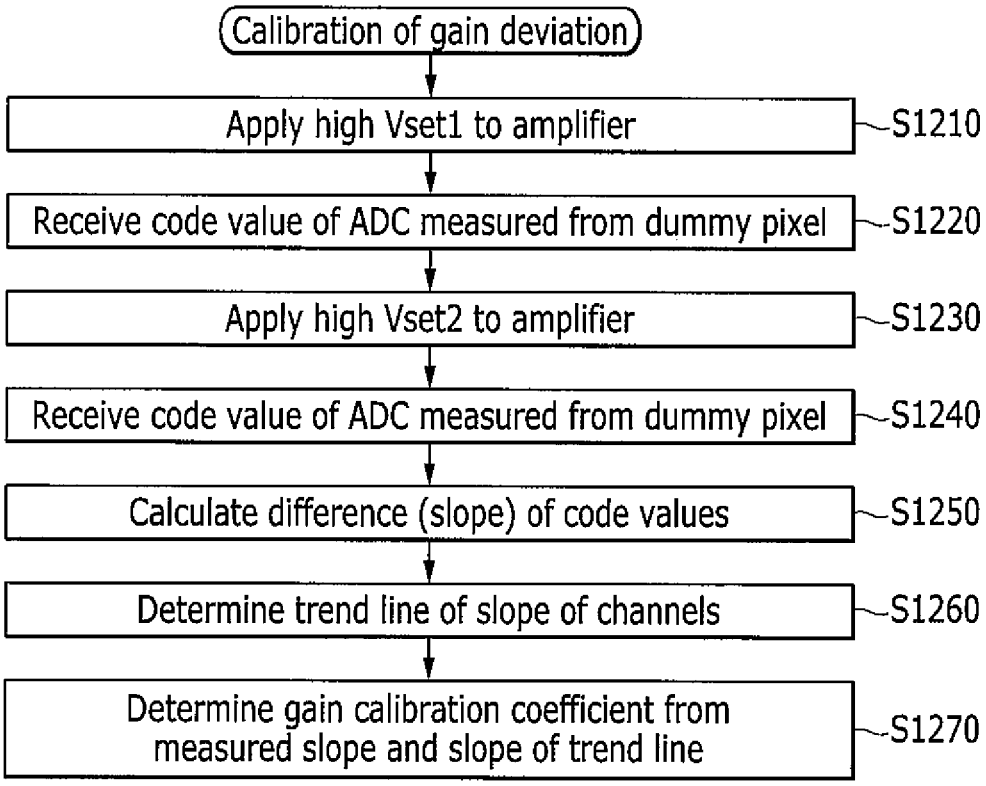
FIG. 12 shows a flowchart of a process for calibrating a gain deviation (or variation) in a calibration method according to another embodiment of the present invention.

FIG. 10 shows a block diagram of a display device according to another embodiment of the present invention, FIG. 11 shows a flowchart of a process for calibrating an offset deviation (or variation) in a calibration method according to another embodiment of the present invention, and FIG. 12 shows a flowchart of a process for calibrating a gain deviation (or variation) in a calibration method according to another embodiment of the present invention.

Referring to FIG. 10, the display device further includes a dummy region 600 outside (e.g., at a side of) the display unit 100.

The dummy region 600 includes a plurality of dummy pixels DPX connected to a plurality of data lines D1-Dm, and a sensor 400 is connected to the dummy pixels DPX. Therefore, the sensor 400 measures the current $I_{EL}$ flowing to the organic light emitting diode LD of the dummy pixel DPX, and the signal controller 500 calibrates input data according to a measurement result of the sensor 400.

The pixel PX may have a structure in which a sensing transistor (e.g., T3 shown in FIG. 3) is omitted, and the dummy pixel DPX may have a structure in which the sensing transistor (e.g., T3 of FIG. 3) is further included in the pixel PX of the display unit 100. Accordingly, in the process for calibrating an offset deviation (or variation) and the process for calibrating a gain deviation (or variation), the sensing transistor is turned on such that the sensor 400 may measure the current flowing to the organic light emitting diode LD of the dummy pixel DPX.

Referring to FIG. 11, in the process for calibrating an offset deviation (or variation), the signal controller 500 controls the amplifier 412 so that a predetermined voltage Vset may be applied to the positive input terminal of the amplifier 412 (S1110). The signal controller 500 receives the outputs of the ADCs 414 determined by the currents flowing to the dummy pixels DPX, that is, the code values (S1120), determines a distribution of offset values in a plurality of channels 410 based on the code values, and determines the offset calibration values for respective channels (S1140).

In some embodiments, the signal controller 500 receives the outputs (code values) of the ADCs 414 measured from a plurality of dummy pixels DPX on each channel 410, and determines the offset calibration value of the corresponding channel based on the average of the code values for the plurality of dummy pixels DPX (S1130).

Referring to FIG. 12, in the process for calibrating a gain deviation (or variation), the signal controller 500 controls the amplifier 412, so that the first voltage Vset1 may be applied to the positive input terminal of the amplifier 412 (S1210), and receives the output of the ADC 414 determined by the current flowing to the dummy pixel DPX, that is, the code value (S1220). The signal controller 500 controls the amplifier 412, so that the second voltage Vset2, rather than the first voltage Vset1, may be applied to the positive input terminal of the amplifier 412 (S1230), and receives the output of the ADC 414 determined by the current flowing to the dummy pixel DPX, that is, the code value (S1240).

The signal controller 500 calculates the difference ΔCode between the code values measured from the first voltage Vset1 and the second voltage Vset2, that is, the slope in the linear section (S1250). In some embodiments, the signal controller 500 calculates an average of the differences ΔCode for a plurality of dummy pixels DPX within the channel, that is, the average of the slopes, as the slope of the corresponding channel. The signal controller 500 finds a distribution diagram of slopes for a plurality of channels, and determines the trend line of the slopes from the distribution diagram (S1260). The signal controller 500 determines the ratio of the slope on the trend line to the slope measured for each channel as a gain calibration coefficient COMP for the corresponding channel (S1270).

Thus, according to some embodiments of the present invention, the deviation (or variation) of the gain and the offset among a plurality of channels may be calibrated by using the dummy pixel outside (e.g., at an external side) of the display area. Further, the deviation (or variation) of gain and offset may be calibrated in real-time by using the dummy pixel outside of the display area.

While example embodiments of the present invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. A display device comprising:

a plurality of pixels;

a plurality of data lines coupled to the pixels and grouped into a plurality of groups;

a plurality of channels corresponding to the plurality of groups, each of the channels being configured to sense a current flowing to a data line of a corresponding group from among the data lines to output a code value; and a controller configured to calibrate a deviation of a gain and an offset of the channels based on the code value of each of the channels, wherein each of the channels comprises an amplifier configured to receive an input voltage, and wherein the controller is configured to calibrate the deviation of the gain by setting the input voltage as a first voltage and a second voltage in turn, and the first voltage and the second voltage are higher than a predetermined voltage to allow a plurality of organic light emitting diodes of the plurality of pixels to be operable in a linear section.

2. The display device of claim 1, wherein each of the channels comprises:

the amplifier comprising a first input terminal, a second input terminal configured to receive the input voltage, and an output terminal coupled to the data line of the corresponding group; and an analog to digital converter (ADC) comprising an input terminal coupled to the first input terminal, and an output terminal configured to output the code value.

3. The display device of claim 2, wherein the controller is configured to calibrate the deviation of the offset by setting the input voltage to be lower than a threshold voltage.

4. The display device of claim 3, wherein the threshold voltage controls a current flowing through the data line to have a value that is less than a predetermined current.

5. The display device of claim 3, wherein the controller is configured to calibrate the deviation of the offset based on the code value output by the ADC when the input voltage is set to be lower than a threshold voltage.

6. The display device of claim 5, wherein the controller is configured to calibrate the deviation of the offset on each of the channels based on an average value of the code values of at least two of the data lines corresponding to each of the channels.

7. A display device comprising:

a plurality of pixels;

a plurality of data lines coupled to the pixels and grouped into a plurality of groups;

a plurality of channels corresponding to the plurality of groups, each of the channels being configured to sense a current flowing to a data line of a corresponding group from among the data lines to output a code value; and a controller configured to calibrate a deviation of a gain and an offset of the channels based on the code value of each of the channels, wherein each of the channels comprises:

an amplifier comprising a first input terminal, a second input terminal configured to receive an input voltage, and an output terminal coupled to the data line of the corresponding group; and an analog to digital converter (ADC) comprising an input terminal coupled to the first input terminal, and an output terminal configured to output the code value, and wherein the controller is configured to calibrate the deviation of the gain by setting the input voltage as a first voltage and a second voltage in turn, and the first voltage and the second voltage are higher than a predetermined voltage.

8. The display device of claim 7, wherein the predetermined voltage controls the current flowing to the data line to be operable in a linear region.

9. The display device of claim 7, wherein the controller is configured to calibrate the deviation of the gain based on a first code value output by the ADC when the input voltage is set to be the first voltage, and a second code value output by the ADC when the input voltage is set to be the second voltage.

10. The display device of claim 9, wherein the controller is configured to calibrate the deviation of the gain based on a slope that corresponds to a difference between the first code value and the second code value.

11. The display device of claim 10, wherein the controller is configured to calculate the slope for each of the channels, determine a trend line of slopes for the plurality of channels, and calibrate the deviation of the gain for each of the channels based on a ratio of the slope on the trend line and the slope calculated for a corresponding channel.

12. The display device of claim 11, wherein the controller is configured to determine an average value of the slopes on at least two of the data lines corresponding to each of the channels to be the slope for the corresponding channel.

13. A method of performing a calibration by a display device comprising a plurality of pixels, a plurality of data lines coupled to the pixels and grouped into a plurality of groups, and a plurality of channels corresponding to the plurality of groups, the method comprising:

sensing a current flowing to a data line of each group from among the data lines by a channel corresponding to the group;

converting the current sensed by the channel into a code value to output the code value; and calibrating a deviation of a gain and an offset of the channel based on the code value, wherein the outputting of the code value comprises:

applying an input voltage to a first input terminal of an amplifier, the amplifier comprising the first input terminal, a second input terminal, and an output terminal coupled to the data line of the corresponding group; and outputting the code value by an analog to digital converter (ADC) comprising an input terminal coupled to the second input terminal, and wherein the calibrating of the deviation comprises:

setting the input voltage to be a first voltage that is higher than a predetermined voltage;

setting the input voltage to be a second voltage that is higher than the predetermined voltage; and calibrating the deviation of the gain based on a first code value output by the ADC when the input voltage is set to be the first voltage, and a second code value output by the ADC when the input voltage is set to be the second voltage.

14. The method of claim 13, wherein the calibrating of the deviation comprises:

setting the input voltage to be lower than a threshold voltage; and calibrating the deviation of the offset based on the code value output by the ADC when the input voltage is set to be lower than the threshold voltage.

15. The method of claim 14, wherein the calibrating of the deviation of the offset further comprises setting an average value of the code values of at least two of the data lines corresponding to the channel to be the code value for calibrating the deviation of the offset.

16. The method of claim 13, wherein the calibrating of the deviation of the gain further comprises calibrating the deviation of the gain based on a slope that corresponds to a difference between the first code value and the second code value.

17. The method of claim 16, wherein the calibrating of the deviation of the gain further comprises:

calculating the slope for each of the channels;

determining a trend line of slopes for the plurality of channels; and calibrating the deviation of the gain based on a ratio of the slope on the trend line to the slope calculated for each of the channels.

18. The method of claim 16, wherein the calibrating of the deviation of the gain further comprises setting an average value of the slopes on at least two of the data lines corresponding to the channel to be the slope for the channel.

* * * * *